US008425998B2

(12) United States Patent
Poulakis

(10) Patent No.: US 8,425,998 B2
(45) Date of Patent: Apr. 23, 2013

(54) FIXING SYSTEM

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 367 days.

(21) Appl. No.: 12/449,069

(22) PCT Filed: Feb. 9, 2008

(86) PCT No.: PCT/EP2008/001001
§ 371 (c)(1),
(2), (4) Date: Jul. 22, 2009

(87) PCT Pub. No.: WO2008/110238
PCT Pub. Date: Sep. 18, 2008

(65) Prior Publication Data

US 2010/0000055 A1 Jan. 7, 2010

(30) Foreign Application Priority Data

Mar. 15, 2007 (DE) ..... 10 2007 012 433

(51) Int. Cl.

| | |
|---|---|
| ***B32B 9/00*** | (2006.01) |
| ***B32B 7/00*** | (2006.01) |
| ***B32B 3/06*** | (2006.01) |
| ***B32B 7/12*** | (2006.01) |
| ***A44B 11/25*** | (2006.01) |

(52) U.S. Cl.
USPC ..... 428/40.1; 428/98; 428/99; 428/100; 428/343; 428/346; 24/304

(58) Field of Classification Search ..... 428/40.1, 428/85, 91, 96–100, 343, 346; 24/442, 447, 24/448, 304
See application file for complete search history.

(56) References Cited

U.S. PATENT DOCUMENTS

| | | | | |
|---|---|---|---|---|
| 3,353,663 | A * | 11/1967 | Flanagan, Jr. et al. | 206/346 |
| 4,822,443 | A | 4/1989 | Dubowik | |
| 4,822,658 | A | 4/1989 | Pacione | |
| 5,691,026 | A * | 11/1997 | Zinke et al. | 428/100 |
| 5,691,027 | A * | 11/1997 | Eckhardt et al. | 428/100 |
| 6,134,755 | A | 10/2000 | McDaniel | |
| 2003/0126724 | A1 | 7/2003 | Kono et al. | |

FOREIGN PATENT DOCUMENTS

| | | | |
|---|---|---|---|
| DE | 15 75 199 | B | 11/1971 |
| DE | 31 01 794 | A1 | 12/1981 |
| DE | 297 15 522 | U1 | 8/1998 |
| DE | 197 24 698 | A1 | 12/1998 |
| DE | 197 52 763 | A1 | 7/1999 |
| DE | 696 24 594 | T2 | 3/2003 |
| DE | 10 2004 058 257 | A1 | 6/2006 |
| FR | 2 463 870 | A1 | 2/1981 |
| FR | 2 883 234 | A1 | 9/2006 |

* cited by examiner

*Primary Examiner* — Patricia Nordmeyer
(74) *Attorney, Agent, or Firm* — Roylance, Abrams, Berdo & Goodman L.L.P.

(57) ABSTRACT

A fixing system has at least one adhesion closure part (9) which can be fixed by its fixing side (7) onto the free side (19) of a fixing part (11). The other functional side of the fixing part is at least partially provided with an active substance (15) which can be activated. When activated, the substance forms a fixing connection with the fixing side (5) of a third part (1,3).

12 Claims, 4 Drawing Sheets

FIXING SYSTEM

FIELD OF THE INVENTION

The invention relates to fixing systems in which one component is formed from a combination of several parts by at least one adhesion closure part.

BACKGROUND OF THE INVENTION

In such fixing systems, the fundamental problem exists of forming a fixed and reliable connection between the fixing side of the participating adhesion closure parts opposite the interlocking side, and an assigned further part of the combination to be formed. The formation of this connection is difficult to produce in all cases or cannot be produced with sufficient reliability when the composition (surface structure) of the pertinent system part is not suited to attaching the conventionally self-adhesive fixing side of the adhesion closure part. This problem appears especially when the pertinent system parts are foam parts, parts with a textile surface or other system parts with surface structuring not suitable for cementing an adhesion closure part with a self-adhesive fixing side.

According to the prior art, in these cases the process is such that a cement connection is produced such that a liquid or spreadable solvent-containing adhesive is applied to the fixing side of the adhesion closure part and of the participating further part, for example, is brushed on. After the adhesive application and a certain airing time, the adhesion closure part is laminated onto the fixing side of the pertinent part. Due to evaporation of the solvent, the use of these adhesives, for example, containing nitrile rubber in a solvent, is extremely problematical. Since the use of these fixing systems often takes place within at least partially closed spaces, evaporating solvent leads to adverse health effects and injury to personnel, as far as disorientation. Therefore in many cases it is necessary to provide protective measures, for example, prescribed breaks, forced ventilation or breathing apparatus for personnel.

SUMMARY OF THE INVENTION

An object of the invention is to provide a fixing system avoiding the aforementioned disadvantages of the prior art.

This object is basically achieved according to the invention by a fixing system. that instead of cementing between the fixing side of the adhesion closure part and the system part to be attached to it by a solvent adhesive, a fixing part is used as an intermediate element. On its action side the intermediate element is provided with an active substance which when activated forms a fixing connection to the fixing side of the pertinent system part to which the adhesion closure part is to be connected. The fixing part connected by activating its active substance to a third part thus forms a system element by which the problematic surface structure of the third part is conditioned such that the adhesion closure part conventionally finished to be self-adhesive can be attached by cementing to the free side of the fixing part. The connection then takes place free of solvent.

The third part on whose surface the fixing part is fixed by the activated active substance can be a carrier part, for example, a cushion foam part of a vehicle or aircraft seat. In this case the adhesion closure part connected to the cushion foam part by the fixing part can be used, for example, as an anchoring element for a seat covering or the like.

In one especially advantageous embodiment, the third part can be a useful part, in particular, a covering, preferably a floor or wall covering. The useful part has a useful surface opposite its fixing side.

In an especially advantageous manner the fixing system can be used as an installation system. The covering is at least one carpet or carpet tile with a carpet side forming the useful surface and a carpet back forming the fixing side. Since the installation of coverings such as carpets or tile takes place conventionally in closed spaces, the possibility of solvent-free working constitutes an especially valuable advantage. After attaching the fixing part, for example, to a carpet back, its fixing side is conditioned such that an adhesion closure part conventionally finished to be self-adhesive can be cemented to the fixing part. The connection takes place without solvent. The cover part prepared in this way, such as a carpet or carpet tile or wall tile, can then be fixed in the conventional manner by interlocking with an adhesion closure part anchored on a base.

The fixing system according to the invention is suited not only for coverings of the aforementioned type, but for coverings of any type, such as, for example, protective floor mats for ground vehicles and aircraft, bathroom mats, trunk mats and the like.

The fixing part can preferably be a flat article formed, in particular, from a plastic film. On at least one side, the article is provided with an active substance, in particular, is coated.

In especially preferred embodiments the active substance can be activated by heating.

Processing is made especially simple when an active substance activated by heating is chosen such that heating to a temperature of less than 150° C., preferably less than 140° C., is sufficient to activate the active substance. In a temperature range limited in this way not only is the danger avoided that thermal degradation of the fixing part or the back of the third part will occur, but thermal lamination of the fixing part can also take place in an especially simple manner by pressing on. This processing can be done without difficulty at the installation site. The pertinent third parts, however, can also be mechanically provided with the fixing part beforehand by the manufacturer, and thus, can be taken to the installation site prepared for installation.

A hot-melt adhesive has proven to be well-suited as the active substance. It can be of a blend of two thermoplastic substances, one with a softening point of not more than 125° C.

Thermoplastic materials suitable for this purpose can be chosen from the groups of copolyamides, polyethyl vinyl acetates, polyvinyl acetates, polyolefins, polyurethanes or copolyesters.

The active substance can also be a hot-melt adhesive based on synthetic rubber. However, its processing temperatures can be in the region of 170° C.

Preferably, the active substance on the flat article provided as the fixing part is applied in an application amount of 80 to 400 g/m$^2$, preferably roughly 200 g/m$^2$.

Handling is made especially simple and convenient when the fixing part is prepared as two film lengths or strips. The side of one film provided with the active substance is covered by the second film protecting the active substance. The second film can be detached for exposing the active substance.

The invention is also a process for installing coverings using the fixing system according to the invention. The process has a kit of system parts of the system according to the invention.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
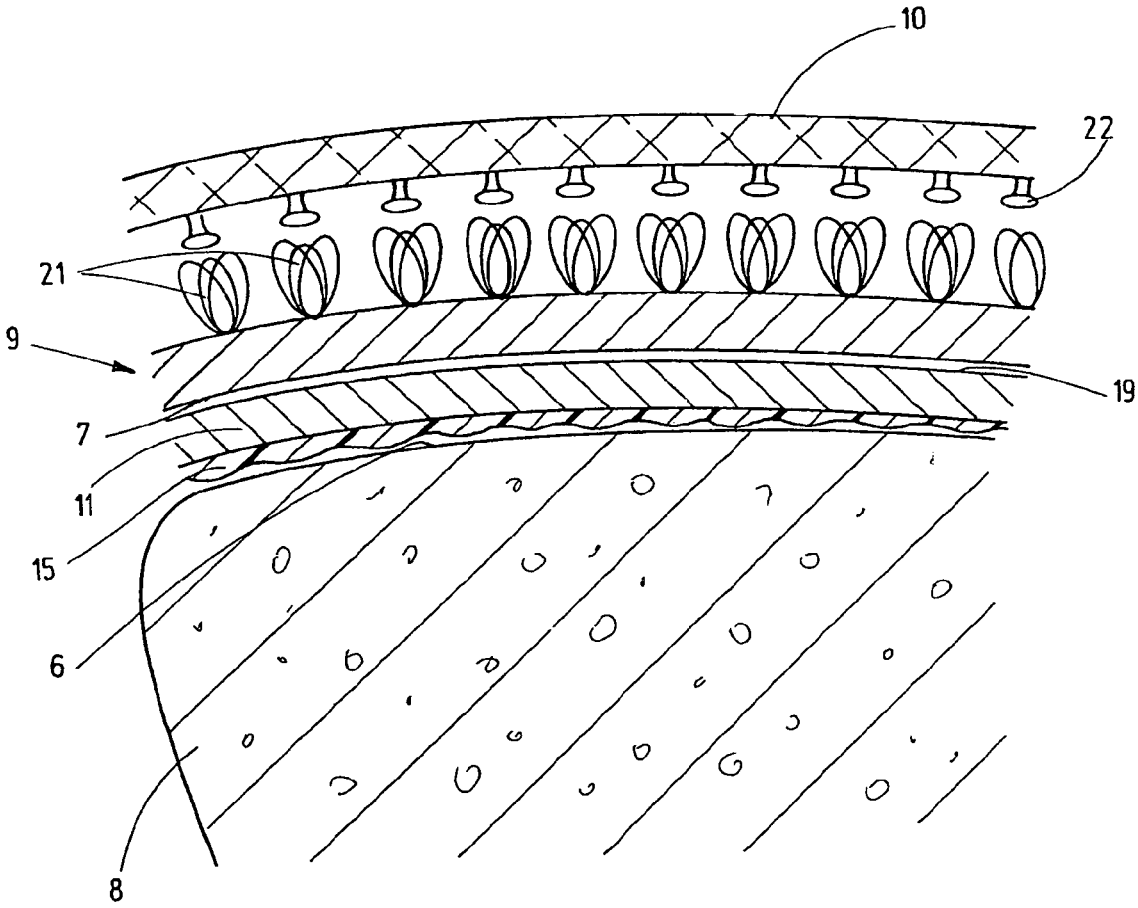
FIG. 1 is a highly schematically simplified side elevational view in section of system according to an exemplary embodiment of the invention, the components being arranged at distances from one another and details being shown exaggerated and not to scale to simplify comprehension.

FIG. 1 is intended to illustrate the invention using one example in which a schematically shown cushion foam part 8 (for example, PU foam) of a passenger seat forms the third part of the system used as a support part for an adhesion closure part 9. The adhesion closure part 9 is to be attached to the cushion foam part 8 and has a carrier 7 with one side used as the fixing side and with another side having interlocking elements 21 interlockable with interlocking elements 22 of another system element, for example with a seat covering 10.

The fixing side 7 conventionally made self-adhesive on the carrier of the adhesion closure part 9 due to the surface structure of the cushion foam part 8 cannot be easily cemented to the foam part free of solvent. According to the invention, conditioning is on the fixing side 6 of the cushion foam part 8. This conditioning is done with a fixing part 11 provided as an intermediate element. On its active side the fixing part 11 is provided with an active substance 15 activatable. When activated, substance 15 forms a connection to the fixing side 6 of the cushion foam part 8. The free side 19 of the fixing part 11 is opposite the active side and has no surface contouring to enable direct, solvent-free cementing of the adhesion closure part 9. Attachment of the fixing part 11 to the cushion foam part 8 provided as the third part by activation of the active substance 15 can take place thermally in advantageous embodiments as described below and results in conditioning on the fixing side 6 of the cushion foam part 8 so that the adhesion closure part 9 can be attached free of solvent.

Figure 2:
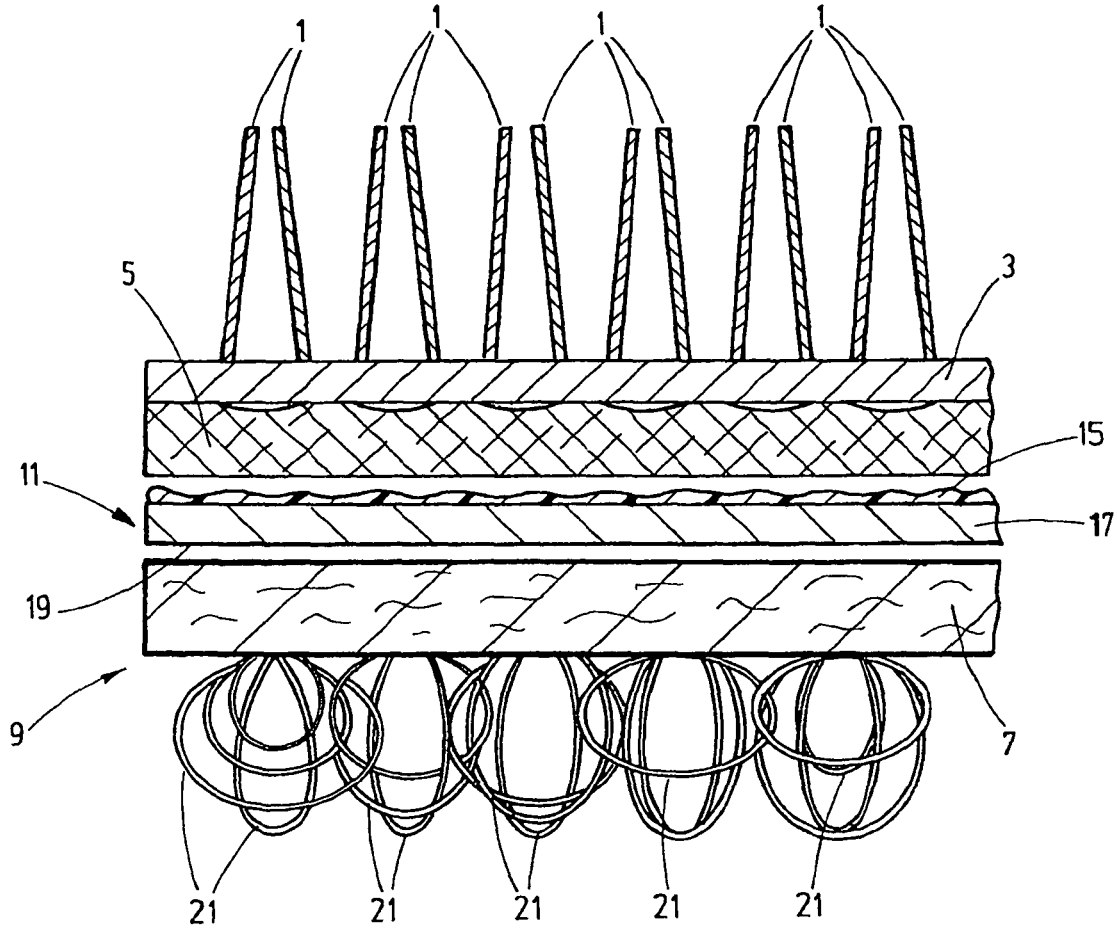
FIG. 2 is a schematically simplified, side elevational view of a section of the components of the fixing system according to the invention in an application as an installation system, the components being arranged at distances from one another and details being shown on a highly exaggerated scale.
Figure 3:
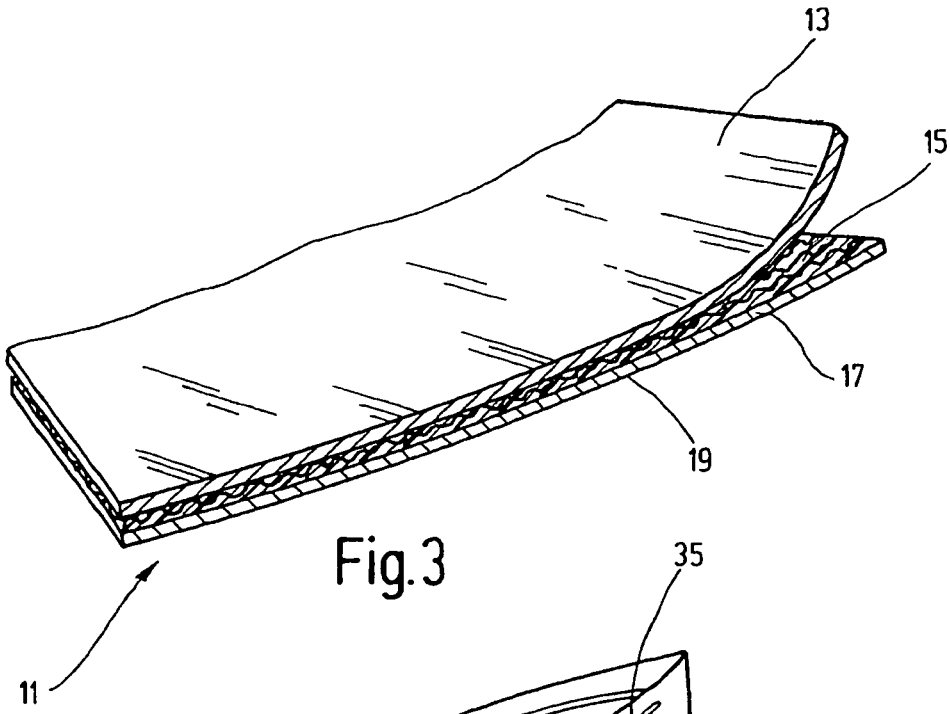
FIG. 3 is a schematically simplified, partial perspective view of a section of the fixing part of the system according to the invention, the material thicknesses shown greatly enlarged.

FIG. 2 shows, in an enlarged, highly schematically simplified representation, a section of the cover part forming a third part in the form of a floor carpet. The carpet's useful surface has pile elements 1 of conventional type extending up from a connecting layer 3. The carpet back 5 opposite the useful surface is formed by a loopless material. Materials imparting to the carpet structure a certain stiffness, directional stability and cutting strength can be used for this purpose. This carpet back can be loose gauze cloth or smooth right/left knits or non-woven materials. Between the carpet back 5 and the carrier 7 of an adhesion closure part 9 is a fixing part 11 shown in FIG. 2 at a distance from the carpet back 5 and from the carrier 7 of the adhesion closure part 9 In FIG. 2, the fixing part 11 is shown in its processing state, with a protective film 13 (FIG. 3) already detached. As FIG. 3 shows, the fixing part 11 forms a strip-like web with a flat article forming the carrier for an active substance 15. The illustrated embodiment is a heat-resistant plastic film 17 of polyester. FIG. 3 shows the release film or protective film 13 only partially detached from the side of the film 17 having the active substance 15.

The free side 19 of the film 17 of the fixing part 11 is shown in FIG. 2 at a distance from the carrier 7 of the adhesion closure part 9, the state before formation of a combination between the adhesion closure part 9 and the carpet back 5. This combination is produced by the fixing part 11 and the carpet back 5 being pressed against one another while the active substance 15 is heated to activate the substance in a solvent-free joining process. A fixed connection between the fixing part 11 and carpet back 5 then takes place. For this purpose, the active substance 15 is a hot-melt adhesive with composition chosen such that activation takes place by heating to a moderate temperature without an adverse thermal effect on the participating system components. Suitable active substances enabling processing in temperature ranges of less than 150° C. are blends of thermoplastic substances, in particular blends having softening points of not more than 125° C. Such blends permit activating the substance 15 by pressing the fixing part 11 against the carpet back 5 with a heating tool or die having temperature is in the region of approximately 150° C. The connection can then be produced between the fixing part 11 and carpet back 5 by pressing without difficulties at the installation site.

Thermoplastic substances being possible components of these blends are, for example, copolyamides, polyethyl vinyl acetates, polyvinyl acetates, polyolefins, polyurethanes or copolyesters.

Hot-melt adhesives can also be those based on synthetic rubber. Optionally comparatively somewhat higher processing temperatures have to be expected.

Application amounts of the hot-melt adhesives to the film 17 of the fixing part 11 are preferably amounts from 80 to 400 $g/m^2$, preferably 200 $g/m^2$ applied by coating.

Figure 4:
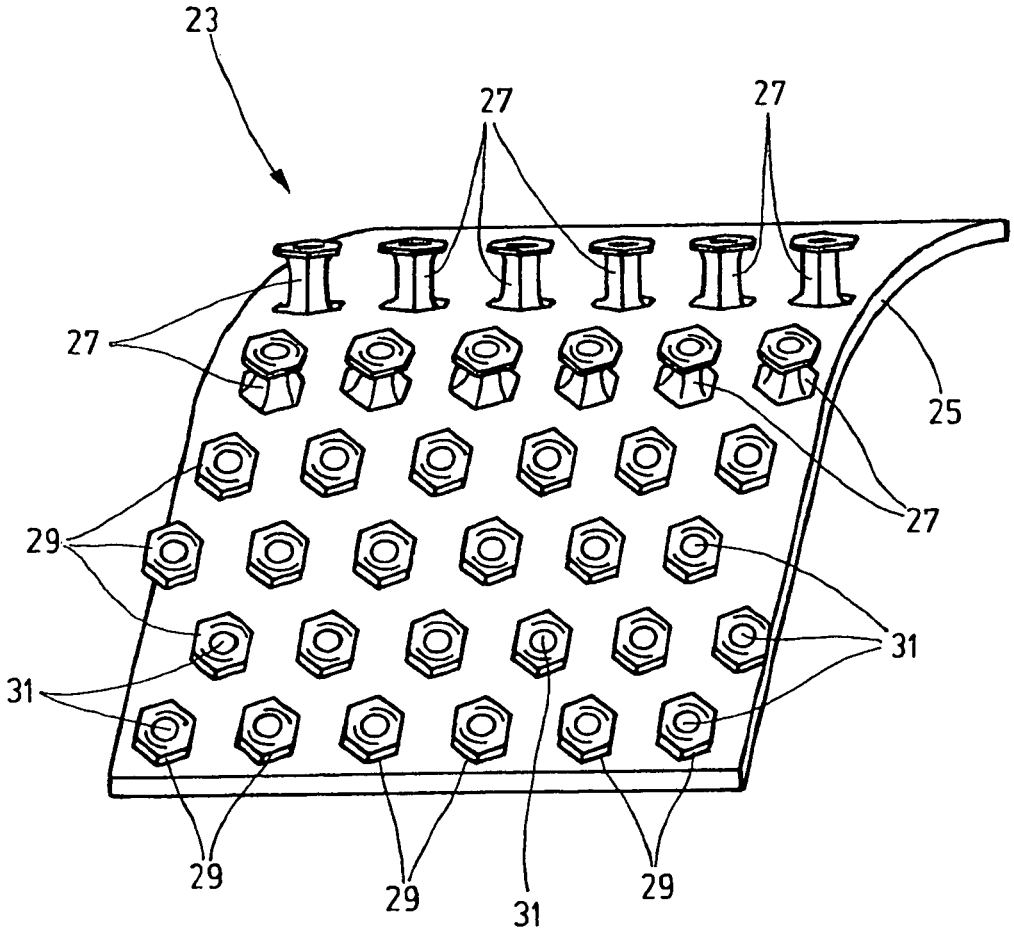
FIG. 4 is a highly schematically simplified, exaggerated perspective view of a partial region of a micro-adhesion closure part of the system according to the invention.

The fixing part 11 fixed on the carpet back 5 enables on its free side 19 cementing of an adhesion closure part 9 to be self-adhesive in the conventional manner on the back of its carrier 7. The adhesion closure part in FIG. 2 for bonding to the other adhesion closure part anchored to the base, for example the floor, has adhesive elements in the form of loops 21. For formation of the adhesion closure with such an adhesion closure part 9, the base-side or floor-side adhesion closure part can be several types of adhesion closure parts, such as, for example, micro-adhesion closure parts. FIG. 4 shows a sample embodiment of micro-adhesion closure parts 23. Micro-adhesion closure parts produced, for example, by the process described in DE 198 28 856 C1 have a film-like carrier 25 formed, for example, from polyolefins or blends of polyamides. Stalks 27 project from carrier 25 (FIG. 4). The thickened ends of the stalks 27 form mushroom-shaped or plate-shaped heads 29 forming the detachable interlocking in the installation process with the loops 21 on the adhesion closure part 9. The packing density in which the stalks 27 are provided on the carrier 25 depends on the mechanical structure and the fineness of the structure of the adhesive elements provided on the adhesion closure part 9. Instead of the loops 21 other types of structures, for example similar mushroom-like or plate-like heads on the stalks, can be provided in the base-side adhesion closure part 23. Depending on the fineness of the structures, the packing density can be several 100 adhesive elements/cm$^2$. The thickness of the carrier 25 can be roughly in the region of 0.5 mm. Other packing densities and/or thicknesses of the carrier 25 are, of course, possible depending on special circumstances.

The selected different configuration of the adhesive elements on the base-side adhesion closure part 23 and on the other adhesion closure part 9 permits setting the adhesive action as desired. If the cover parts are to be re-installed, lifting is possible without the base-side adhesion closure part 23 being raised at the same time. This capability enables re-installation on the remaining adhesion closure part 23.

When an especially high adhesive action is desired, if, for example, re-installation is not an option, on the top of the heads 29, drops 31 of adhesive (FIG. 4) can be applied, for example, by spreading or doctoring to cause additional bonding after completed interlocking engagement with the adhesion closure part 9. The adhesives can be, for example, acrylate-based contact adhesives.

Instead of the illustrated structures of the adhesive elements on the adhesion closure parts 9 and 23, those structures can be as disclosed in DE 103 25 372 C1, i.e., adhesive elements formed from individual fibers extending from the free end of stalks on which interlocking heads are not formed. As described in this document, several 1000 stalks/cm$^2$ can be on the carrier surface, with preferably approximately 500 individual fibers per stalk. The plastic material comprising the individual stalks and their individual fibers can be especially plastics with long molecular chains and good orientation behavior.

Figure 5:
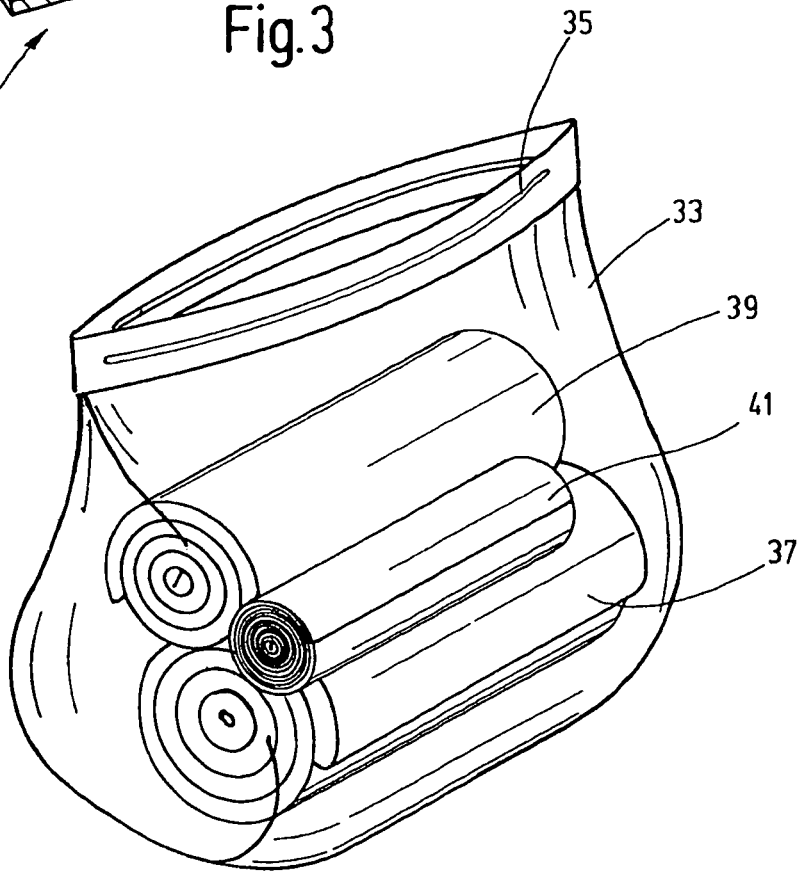
FIG. 5 is a simplified perspective view of a bag containing the system components.

FIG. 5 shows in a schematically simplified form a commercial kit containing the main components of the system according to the invention in a bag 33. The bag is made as a conventional plastic bag with an easily openable closure strip 35. In the bag 33 the base-side adhesion closure part 23 is rolled into a spool 37. The adhesion closure part 9 is rolled into a second spool 39. The cover part is rolled into a third spool 41. A corresponding length of the fixing part 11 in its initial state in which the film 17 bearing the active substance 15 is covered with a detachable protective film 13.

The illustrated fixing system can be also be made in the manner of a flame-retardant closure. The entire adhesion closure part 9 or components thereof is formed of materials which are poorly flammable. These poorly flammable materials can also be made of an active extinguishing medium or contain these active extinguishing substances applied to the respective adhesion closure part 9 as a coating. Especially advantageous materials are from the following groups of substances:

ammonium phosphate (AP),
ammonium polyphosphate (APP),
aluminum trihydroxide (ATH),
magnesium hydroxide (MDH),
resorcinol bis-diphenyl phosphate (PDP),
red phosphorus (RP),
tri-n-butyl phosphate (TBP),
tricresyl phosphate (TCP),
triphenyl phosphate (TPP),
melamine.

Nanoparticles can also be incorporated into the carrier strip of the adhesion closure part 9, such as silicates or graphite, which likewise act in a flame retardant manner. The introduction of enclosed nitrogen gas in the form of nanoparticles into the adhesion closure part 9 would also be possible to obtain an active extinguishing medium by way of an inert gas.

While one embodiment has been chosen to illustrate the invention, it will be understood by those skilled in the art that various changes and modifications can be made therein without departing from the scope of the invention as defined in the appended claims.

What is claimed is:

1. A fixing device, comprising:

at least one adhesion closure part having a carrier with a fixing side and adhesive elements extending from an opposite side of said carrier;

a flat fixing part being a strip-shaped web formed of a plastic film having a free side and an active carrier side, said fixing side of said adhesion closure part being fixed on said free side of said fixing part; and an activatable active substance coated on said active carrier side of said film forming a fixing connection to a fixing side of a useful part activated upon heating of said active substance, said useful part being a covering and having a useful surface opposite said fixing side thereof, said active substance including a blend of at least two thermoplastic substances having a softening point not greater than 125° C. and being applied on said active carrier side in an amount of 80 to 400 g/m$^2$.

2. A fixing device according to claim 1 wherein said covering is one of a floor covering and a wall covering.

3. A fixing device according to claim 1 wherein said covering is a cushion foam part of a vehicle seat.

4. A fixing device according to claim 1 wherein said covering is at least one of a carpet and a carpet tile with a carpet side forming said useful surface and with a carpet back forming said fixing side thereof.

5. A fixing device according to claim 1 wherein said thermoplastic substances are selected from the group consisting of copolyamides, polyethylvinyl acetates, polyvinyl acetates, polyolefins, polyurethanes and copolyesters.

6. A fixing device according to claim 1 wherein said active substance is a hot-melt adhesive based on synthetic rubber.

7. A fixing device according to claim 1 wherein said amount is approximately 200 g/m$^2$.

8. A fixing device according to claim 1 wherein said film is thermally stable in a temperature range that activates said active substance.

9. A process for installing coverings comprising the steps of:

anchoring of at least one first adhesive closure part with first adhesive elements extending from one side on a base, the adhesive closing part having a fixing side opposite the adhesive elements;

pressing a flat fixing part being a strip-shaped web formed of a plastic film and having an activatable active substance coated on an active carrier side of the film onto a fixing side of a covering with the active substance pressed thereon, the active substance including a blend of at least two thermoplastic substances having a softening point not greater than 125° C. and being applied on said active carrier side in an amount of 80 to 400 g/m$^2$;

heating the active substance to form a connection of the fixing part to the fixing side of the covering by the active substance;

fixing a second closure part matable with the first closure part to a free side of the fixing part opposite the active carrier side of the film such that second adhesive elements thereof are exposed; and connecting the adhesive elements of the first and second closure parts to fix the covering to the base.

10. A process according to claim 9 wherein the base is a floor.

11. A process according to claim 9 wherein a movable heated pressing part activates the active substance and presses the fixing part onto the fixing side of the covering.

12. A kit of fixing system parts, comprising:

a closable and openable bag;

a first spool in said bag of a length of a flat fixing part being a strip-shaped web formed of a plastic film having a free side and an active carrier side and having a heat activatable active substance coated on said active carrier side of said film, a detachable protective film overlying said active substance, said active substance including a blend of at least two thermoplastic substances having a softening point not greater than 125° C. and being applied on the active carrier side in an amount of 80 to 400 g/m$^2$;

a second spool in said bag of a length of a first adhesive closure part with a carrier and adhesive elements extending from said carrier; and a third spool in said bag of a length of a second adhesive closure part matable with said adhesive elements of said first adhesive closure part.

* * * * *